US006044507A

United States Patent [19]

Smith

[11] Patent Number: 6,044,507

[45] Date of Patent: Apr. 4, 2000

[54] APPARATUS FOR ASSISTING A HUMAN BETWEEN SITTING AND ERECT POSITIONS RELATIVE TO A CHAIR OR ANY SIMILAR STRUCTURE

[76] Inventor: Tommy Ray Smith, HC 52, Box 939, Hemphill, Tex. 75948

[21] Appl. No.: 09/098,682

[22] Filed: Jun. 15, 1998

[51] Int. Cl.[7] ..... A47C 31/00

[52] U.S. Cl. ..... 5/662; 248/158

[58] Field of Search ..... 5/662, 658; 248/158

[56] References Cited

U.S. PATENT DOCUMENTS 5,507,044 4/1996 Williamson et al. ..... 5/662

5,524,303 6/1996 Palmer, Jr. et al. ..... 5/662 X 5,560,053 10/1996 Mills ..... 5/662

5,588,352 12/1996 O'brien et al. ..... 5/662

*Primary Examiner*—Ramon O. Ramirez

*Attorney, Agent, or Firm*—Beirne Maynard & Parsons, LLP

[57] ABSTRACT

An apparatus is provided for assisting a human between sitting and erect positions relative to a chair. A support strut extends from a base plate with the support strut angularly offset away from the chair when the apparatus is positioned frontal of the chair from a vertical line 90° perpendicular to the top face of the base member. A plurality of elevationally separated hand graspable recepticals are defined offset and away from the support strut. The unit is compact and easily transportable from storage to use locations.

6 Claims, 2 Drawing Sheets

APPARATUS FOR ASSISTING A HUMAN BETWEEN SITTING AND ERECT POSITIONS RELATIVE TO A CHAIR OR ANY SIMILAR STRUCTURE

BACKGROUND OF THE INVENTION (1) Field of the Invention

The invention is directed to an apparatus for assisting a human into and out of a chair, sofa or the like.

(2) Brief Description of the Prior Art

It is a known fact that, as the human body ages, ease of mobility becomes more and more difficult. In addition to the aging factor, mobility is often reduced or considerably impaired due to arthritic and other diseases affecting bone structure and muscle tissues. It is also known that changes in the weather, such as temperature and humidity variances, often times adversely affect a person's ability to walk, sit, or stand up.

It occurs quite frequently that such impaired or adversely affected individuals will have some difficulty in getting into and, particularly, getting out of a chair, sofa, bed, or the like. In dramatic situations, such individuals frequently require the assistance of another human in moving from one such position to another position, particularly, from a sitting position to a fully erect position. In effect, such person's center of gravity resists in combination with slow movements and lack of momentum or interferes with the movement of the body between such positions. In fact, the slower one moves between such positions, the more difficult it is to successfully and independently move from one such position to the other such position.

The present invention addresses the problems set forth above.

SUMMARY OF THE INVENTION

The present invention provides an apparatus for assisting a disabled, or partially or temporarily disabled human between sitting and erect positions relative to a chair or the like, said apparatus being frontally, selectively arrangeable relative to the chair. The apparatus comprises a base member having top and bottom opposed face members. The bottom face member is placeable in substantial flat horizontal alignment on a surface frontal of said chair. The top face defines a shape for the positioning of human feet thereon prior to and during movements of the human using the apparatus between sitting and standing positions. The apparatus includes a support strut extending upwardly from the top face of the base member and is fixedly mounted relative to the base. The support is angularly offset away from the chair when the apparatus is positioned frontal of the chair from a vertical line 90° perpendicular to the top face of said base member. A plurality of elevationally separated hand graspable recepticals are defined on the upwardly extending support strut and include receptacle members offset from the strut for grasping by the human hand. Thus, when operated, the angular offset of the strut and the application of human weight through the feet on the base causes the center of gravity of the human operator to move frontally when the hands are applied to the graspable recepticals, such that pulling by the human operator of the body weight through the hands on the graspable recepticals in combination with the slight frontal movement of the center of gravity urges the human operator to an erect position when standing on the apparatus and thus overcome the lack of independent mobility required by an individual to sit or stand without assistance. Likewise, the operational steps are reversed to safely place the human operator into the chair in a sitting position.

DESCRIPTION OF THE PREFERRED EMBODIMENTS

Figure 1:
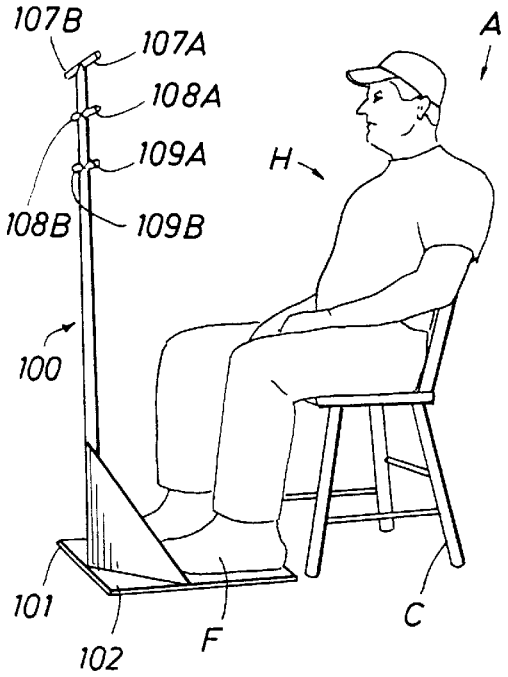
FIG. 1 is a perspective view of the apparatus positioned relative to a chair upon which the human operator is seated with feet applied on the base member.
Figure 4:
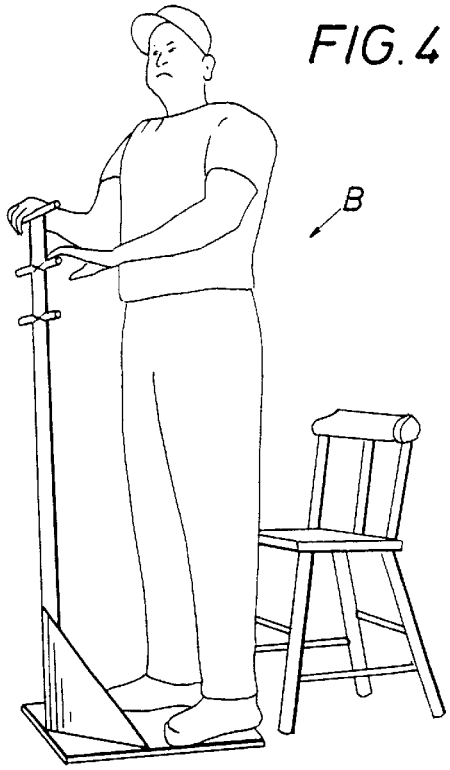
FIG. 4 is a view similar to those of FIGS. 1 through 3, inclusive, illustrating use of the apparatus by the human operator in the standing position either prior to or after being placed in a comfortable sitting position in a chair.

Now with first reference to FIG. 1, a human operator H is shown in a sitting position A upon a chair C with feet F in place upon the apparatus 100. The apparatus 100 is in position for assisting the human operator H from the sitting position A to the erect position B (FIG. 4). The apparatus 100 includes a plate-like flat base member 101 having a top face 102 upon which the feet F of the human operator H are placed when the apparatus 100 is to be utilized. The base member 101 also has an opposing bottom smooth face 103 which extends across the floor, carpeting, or other surface immediately in front of the chair C, during operation. For safety purposes, the bottom face 103 may consist of a rubberized or similar material or contour which is secured across the bottom face 103 with an adhesive, or other permanently securing means. Likewise, as an additional safety and convenience feature, the base member 101 may have a rubberized bumper or coating extending around the slightly raised edge between the faces 102 and 103 and defining the height, or thickness, of the base member 101.

An elongated strut or bar member 104 is permanently secured to the base member 101 at the top face 102. The strut 104 is angularly offset an amount 106 from a vertical line 105 90° perpendicular to the top face 102 of the base member 101 such that the support strut 104 angularly extends away, or is offset an angle 106 and a distance 106A at the immediate top thereof relative to the lower end of the strut 106 affixed to face 102. It is this angular offset and positioning of the strut 104 relative to the base member 101 that is particularly important in enabling the human operator H to move between the sitting position A and the erect position B for the chair D. Preferably the angle of the offset 106 will be about 95°, but may be from between about 93° and about 103°. Another way of providing the correct angular offset from the perpendicular line is to offset the strut 104 one inch for each foot of height of the strut 104. For example, if the strut 104 is five feet in height, the top end should be offset five inches from the lower end of the member 104 secured to the base 101 to thus provide the correct angular offset.

Figure 5:
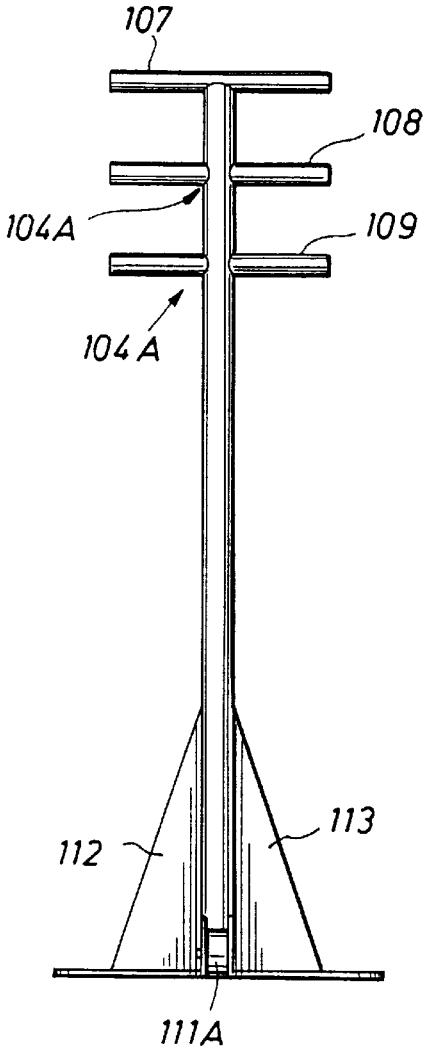
FIG. 5 is a rear view of the device.

Now, with particular reference to FIGS. 1 and 5, a plurality of graspable recepticals, or bars 107, 108 and 109 are vertically spaced from one another on the support strut 104 and include oppositely opposed left and right member elements 107A and B; 108A and B; and 109A and B. The recepticals 107, 108 and 109 may be secured to the strut 104 in any known permanent affixation means, such as welding or the like. Alternatively, the recepticals 107, 108 and 109 may be single, separate bars or other members which extend through respective openings 104A bored through the strut 104 and inserted therein. In this fashion, the graspable recepticals 107, 108 and 109 may be removed from the strut 104 for storage of the apparatus 100 and reinsertable as described prior to operation.

The graspable recepticals may include a rubberized or other supporting soft cushioning 110 which is simply placed thereover, as convenient.

The apparatus 100 also includes transporting means 111, such as a wheel 111A and housing 111B therefor, secured at the portion of the base member 101 opposite of the human operator H when the apparatus 100 is to be utilized.

Figure 6:
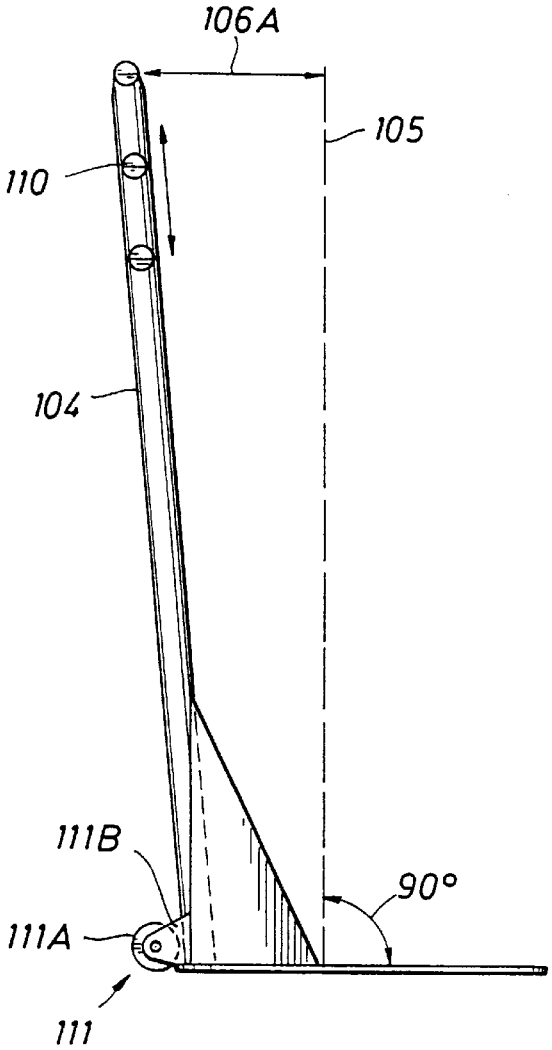
FIG. 6 is a side elevational view of the apparatus of the present invention.
Figure 7:
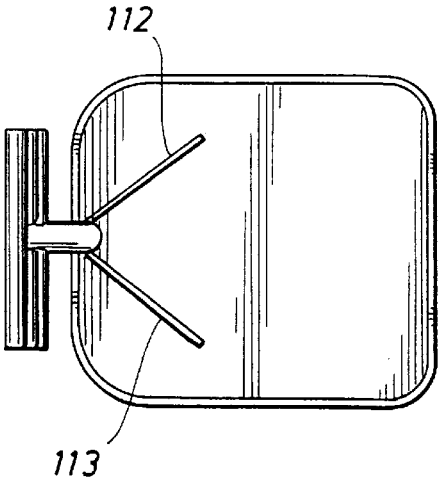
FIG. 7 is a view of the device looking down upon the base.

Also, as seen in FIGS. 5, 6 and 7, the apparatus 100 may include support wings 112 and 113 to further permanently secure the strut 104 to the base member 101.

OPERATION

Figure 2:
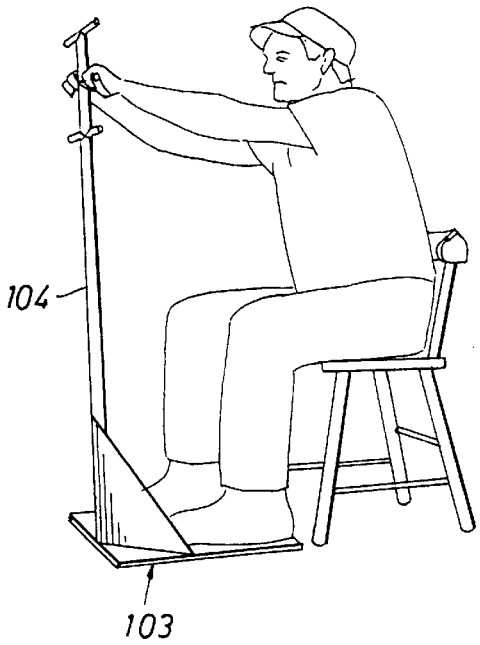
FIG. 2 is a view similar to that of FIG. 1 showing slight movement forward of the human operator subsequent to grasping of one of the series of hand graspable recepticals with each hand.
Figure 3:
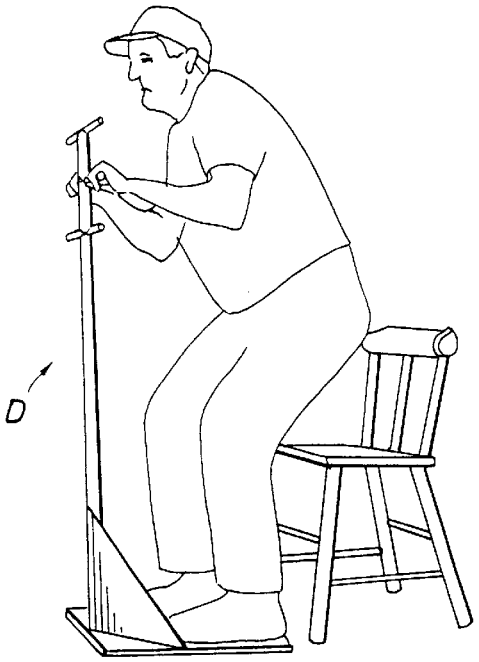
FIG. 3 is a view similar to those of FIG. 1 and FIG. 2 illustrating the intermediate positioning of the human operator between sitting and standing positions.

Now with reference to FIGS. 1 through 4, when it is desired for the human operator H to be assisted by use of the apparatus 100 in moving from the sitting position A in the chair C through the intermediate position D (FIG. 3) to the erect position B (FIG. 4), the apparatus 100 is positioned either by the human operator H or an assistant, in front of the chair C as shown in FIG. 1. The human operator H then places his/her feet F on the top face 102 of the base member 101. As shown in FIG. 2, the operator H then extends arms forwardly for grasping of the selected receptacle 107, 108, or 109, depending upon the shoulder height of the human operator H sitting in the chair C (or, if moving from the erect position B to the sitting position A, at a selected receptacle which is comfortable to the human operator H). After grasping the selected receptacle 107, 108 or 109, the human operator H then begins to apply weight through the feet F on the base member 101 and pulls to the position as shown in FIG. 3, such that the positioning of the body of the operator H as shown in FIG. 3 has pivoted or shifted the center of gravity somewhat forwardly. The human operator H then may easily move to the standing position B as shown in FIG. 4.

When it is desired to return to the sitting position A in the chair C, the sequence of steps is reversed.

The apparatus 100 will assist a human operator H equally well when it is desired to be accommodated into or out of a sofa, bed, or any other similar application.

The height of the strut 104 extending from the top face 102 of the base member 101 is not particularly critical to the invention, but should be sufficient such that the selected recepticals 107, 108 and 109 is at approximate eye level or slightly lower relative to the human operator H sitting in the chair C since it is preferred to provide one or more of the recepticals 107, 108 and 109, etc., somewhat between eye level and shoulder level of the typical human operator H in the sitting position. It will, of course, be appreciated that the recepticals 107, 108, and 109 may be placed in one, or a number of locations vertically along the strut 104.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. An apparatus for assisting a human between sitting and erect positions relative to a chair and frontally selectively arranged relative to the chair, comprising:

(a) a base member having top and bottom opposed face members, the bottom face member being placeable in substantial flat horizontal alignment on a surface frontal of said chair, the top face thereof defining a shape for positioning of human feet thereon;

(b) a front support strut extending upwardly from the top face of said base members and fixedly mounted relative to said base, said support strut having upper and lower ends and being angularly offset away from said chair from a vertical line 90° perpendicular to the top face of said base member; and (c) a plurality of elevationally separated hand graspable recepticals having receptacle members offset from said support strut.

2. The apparatus of claim 1: each of said graspable recepticals including exterior cushioning thereon.

3. The apparatus of claim 1 wherein the angular offset is from between about 93° and about 103° from said vertical line and angled away from said chair when said apparatus is selectively positioned relative to said chair for human assistance.

4. The apparatus of claim 1 further comprising transporting means mounted between the strut and the base member for aligning the apparatus relative to the chair and the human.

5. The apparatus of claim 1 further comprising first and second support wings extending away from said strut and secured to said base for terminating the positioning of the human feet on the base at one end thereof.

6. The apparatus of claim 1 wherein the angular offset of the front support strut is provided by the upper end of the strut being offset from the lower end one inch for each foot in height of said strut.

* * * * *